US007168637B2

(12) United States Patent
Goenka et al.

(10) Patent No.: US 7,168,637 B2
(45) Date of Patent: Jan. 30, 2007

(54) LOW PRESSURE FUEL INJECTOR NOZZLE

(75) Inventors: Lakhi N. Goenka, Ann Arbor, MI (US); Jeffrey Paul Mara, Livonia, MI (US); David Lee Porter, Westland, MI (US); David Ling-Shun Hung, Novi, MI (US); John Stefanski, Pinckney, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 15 days.

(21) Appl. No.: 10/983,118

(22) Filed: Nov. 5, 2004

(65) Prior Publication Data

US 2006/0097081 A1 May 11, 2006

(51) Int. Cl.
*B05B 1/34* (2006.01)
*F02M 61/00* (2006.01)

(52) U.S. Cl. ..... 239/497; 239/88; 239/533.12; 239/533.14; 239/593; 239/596; 239/598

(58) Field of Classification Search ..... 239/88–96, 239/533.2, 533.11, 533.12, 533.14, 589, 593, 239/592, 596, 597, 598, 491–497
See application file for complete search history.

(56) References Cited

U.S. PATENT DOCUMENTS 3,326,191 A 6/1967 Berlyn
4,018,387 A 4/1977 Erb et al.
4,106,702 A 8/1978 Gardner et al.
4,139,158 A 2/1979 Uehida
4,254,915 A 3/1981 Muller
4,275,845 A 6/1981 Muller
4,346,848 A 8/1982 Malcolm
4,540,126 A 9/1985 Yoneda et al.
4,650,122 A 3/1987 Kienzle et al.
4,666,088 A 5/1987 Krauss et al.
4,801,095 A 1/1989 Banzhaf et al.
4,907,748 A 3/1990 Gardner et al.
5,163,621 A 11/1992 Kato et al.
5,201,806 A 4/1993 Wood
5,244,154 A 9/1993 Buchholz et al.
5,344,081 A 9/1994 Wakeman
5,383,597 A * 1/1995 Sooriakumar et al. ..... 239/5
5,402,943 A 4/1995 King et al.
5,449,114 A * 9/1995 Wells et al. ..... 239/5
5,492,277 A * 2/1996 Tani et al. ..... 239/585.5
5,497,947 A 3/1996 Potz et al.
5,533,482 A 7/1996 Naitoh
5,553,790 A 9/1996 Findler et al.
5,570,841 A 11/1996 Pace et al.

(Continued)

FOREIGN PATENT DOCUMENTS

EP 0 551 633 A1 7/1993

(Continued)

*Primary Examiner*—David A. Scherbel
*Assistant Examiner*—Seth Barney
(74) *Attorney, Agent, or Firm*—Brinks Hofer Gilson & Lione

(57) ABSTRACT

A nozzle for a low pressure fuel injector that improves the control and size of the spray angle, as well as enhances the atomization of the fuel delivered to a cylinder of an engine.

18 Claims, 4 Drawing Sheets

U.S. PATENT DOCUMENTS 5,636,796 A 6/1997 Oguma
5,662,277 A 9/1997 Taubitz et al.
5,685,485 A 11/1997 Mock et al.
5,685,491 A 11/1997 Marks et al.
5,716,001 A 2/1998 Wakeman et al.
5,716,009 A 2/1998 Ogihara et al.
5,762,272 A 6/1998 Tani et al.
5,911,366 A 6/1999 Maier et al.
5,915,352 A 6/1999 Okamoto et al.
5,924,634 A 7/1999 Arndt et al.
5,934,571 A 8/1999 Schmidt et al.
6,029,913 A 2/2000 Stroia et al.
6,045,063 A 4/2000 Koike et al.
6,050,507 A 4/2000 Holzgrefe et al.
6,092,743 A 7/2000 Shibata et al.
6,102,299 A 8/2000 Pace et al.
6,145,761 A * 11/2000 Muller et al. ..... 239/533.12
6,168,094 B1 1/2001 Schatz et al.
6,168,095 B1 1/2001 Seitter et al.
6,176,441 B1 1/2001 Munezane et al.
6,257,496 B1 7/2001 Wyant
6,273,349 B1 8/2001 Fischbach et al.
6,296,199 B1 10/2001 Noller et al.
6,308,901 B1 10/2001 Nitkiewicz et al.
6,330,981 B1 12/2001 Nally, Jr. et al.
6,394,367 B1 5/2002 Munezane et al.
6,405,945 B1 6/2002 Dobrin
6,439,482 B1 8/2002 Hosoyama et al.
6,439,484 B1 8/2002 Harata et al.
6,494,388 B1 12/2002 Mueller et al.
6,499,674 B1 12/2002 Ren et al.
6,502,769 B1 1/2003 Imoehl
6,513,724 B1 2/2003 Joseph et al.
6,520,145 B1 2/2003 Hunkert
6,533,197 B1 3/2003 Takeuchi et al.
6,547,163 B1 4/2003 Mansour et al.
6,578,778 B1 6/2003 Koizumi et al.
6,581,574 B1 6/2003 Moran et al.
6,616,072 B1 9/2003 Harata et al.
6,626,381 B1 9/2003 Parrish
6,644,565 B1 11/2003 Hockenberger
6,666,388 B1 12/2003 Ricco
6,669,103 B1 12/2003 Tsai
6,669,116 B1 12/2003 Iwase
6,685,112 B1 2/2004 Hornby et al.
6,695,229 B1 2/2004 Heinbuch et al.
6,705,274 B1 3/2004 Kubo
6,708,904 B1 3/2004 Itatsu
6,708,905 B1 3/2004 Borissov et al.
6,708,907 B1 3/2004 Fochtman et al.
6,712,037 B1 3/2004 Xu
6,719,223 B1 4/2004 Yukinawa et al.
6,722,340 B1 4/2004 Sukegawa et al.
6,739,525 B1 5/2004 Dantes et al.
6,742,727 B1 6/2004 Peterson, Jr.
6,758,420 B1 7/2004 Arioka et al.
6,764,033 B1 7/2004 Dantes et al.
6,766,969 B1 7/2004 Haltiner, Jr. et al.
6,783,085 B1 * 8/2004 Xu ..... 239/463
6,817,545 B1 11/2004 Xu
6,848,636 B1 2/2005 Munezane et al.
6,921,022 B1 7/2005 Nally et al.
6,929,196 B1 8/2005 Togashi et al.
6,966,499 B1 11/2005 Nally et al.
2001/0017325 A1 8/2001 Harata et al.
2002/0008166 A1 1/2002 Fukaya et al.
2002/0092929 A1 7/2002 Arimoto
2002/0144671 A1 10/2002 Shiraishi et al.
2002/0170987 A1 11/2002 Aoki et al.
2003/0127540 A1 7/2003 Xu
2003/0127547 A1 7/2003 Nowak
2003/0141385 A1 7/2003 Xu
2003/0141387 A1 7/2003 Xu
2003/0173430 A1 9/2003 Spencer
2003/0234005 A1 12/2003 Sumisha et al.
2003/0234302 A1 * 12/2003 Varble et al. ..... 239/533.12
2004/0050976 A1 3/2004 Kitamura
2004/0060538 A1 4/2004 Togashi et al.
2004/0104285 A1 * 6/2004 Okamoto et al. ..... 239/533.12
2004/0129806 A1 7/2004 Dantes et al.

FOREIGN PATENT DOCUMENTS

EP 0 611 886 B1 12/1998
GB 2 232 203 A 12/1990
JP 2-19654 1/1990
JP 5-280442 1/1993
JP 6-221163 8/1994
JP 2001-046919 2/2001
WO WO 93/04277 3/1993
WO WO 93/20349 10/1993
WO WO 95/04881 2/1995

* cited by examiner

LOW PRESSURE FUEL INJECTOR NOZZLE

FIELD OF THE INVENTION

The present invention relates generally to fuel injectors for automotive engines, and more particularly relates to fuel injector nozzles capable of atomizing fuel at relatively low pressures.

BACKGROUND OF THE INVENTION

Stringent emission standards for internal combustion engines suggest the use of advanced fuel metering techniques that provide extremely small fuel droplets. The fine atomization of the fuel not only improves emission quality of the exhaust, but also improves the cold weather start capabilities, fuel consumption and performance. Typically, optimization of the droplet sizes dependent upon the pressure of the fuel, and requires high pressure delivery at roughly 7 to 10 MPa. However, a higher fuel delivery pressure causes greater dissipation of the fuel within the cylinder, and propagates the fuel further outward away from the injector nozzle. This propagation makes it more likely that the fuel spray will condense on the walls of the cylinder and the top surface of the piston, which decreases the efficiency of the combustion and increases emissions.

To address these problems, a fuel injection system has been proposed which utilizes low pressure fuel, define herein as generally less than 4 MPa, while at the same time providing sufficient atomization of the fuel. One exemplary system is found in U.S. Pat. No. 6,712,037, commonly owned by the Assignee of the present invention, the disclosure of which is hereby incorporated by reference in its entirety. Generally, such low pressure fuel injectors employ sharp edges at the nozzle orifice for atomization and acceleration of the fuel. However, the relatively low pressure of the fuel and the sharp edges result in the spray being difficult to direct and reduces the range of the spray. More particularly, the spray angle or cone angle produced by the nozzle is somewhat more narrow. At the same time, additional improvement to the atomization of the low pressure fuel would only serve to increase the efficiency and operation of the engine and fuel injector.

Accordingly, there exists a need to provide a fuel injector having a nozzle design capable of sufficiently injecting low pressure fuel while increasing the control and size of the spray angle, as well as enhancing the atomization of the fuel.

BRIEF SUMMARY OF THE INVENTION

One embodiment of the present invention provides a nozzle for a low pressure fuel injector that enhances the atomization of the fuel delivered to a cylinder of an engine. The nozzle generally comprises a nozzle body defining a valve outlet in a longitudinal axis. A metering plate is connected to the nozzle body and is in fluid communication with the valve outlet. The metering plate defines a nozzle cavity receiving fuel from the valve outlet. A plurality of exit cavities are define in the metering plate which receive fuel from the nozzle cavity. Each exit cavity is radially spaced from the longitudinal axis an oriented along a radial axis. Each exit cavity meets the nozzle cavity at an exit orifice. Each exit cavity is oriented asymmetrically relative to the radial axis.

According to more detailed aspects, each exit orifice has one or more axis of symmetry, and no axis of symmetry is aligned with the radial axis of the exit cavity. As such, the exit orifice may be triangular, trapezoidal, square, rectangular, ellipsoidal among numerous other shapes.

Another embodiment of the present invention provides a nozzle for a low pressure fuel injector generally comprising a nozzle body and a metering plate. The nozzle body defines a valve outlet in a longitudinal axis. The metering plate is connected to the nozzle body and is in fluid communication with the valve outlet. The metering plate defines a nozzle cavity receiving fuel from the valve outlet, the nozzle cavity defined by a side wall and bottom wall. The metering plate also defines a plurality of exit cavities receiving fuel from the nozzle cavity. Each exit cavity is radially spaced from the longitudinal axis and is oriented along a radial axis. The side wall of the nozzle cavity is positioned adjacent the plurality of exit cavities and is structured to provide a tangential component to the fuel flowing into the plurality of exit cavities.

According to more detailed aspects, the sidewalls comprise of a series or arcuate segments. Preferably, the curvature of the arcuate segments is asymmetric relative to the radial axis. Most preferably, the curvature of the arcuate segments has a changing slope. Thus, the sidewall has a flower-shape with pedals that are oblong.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
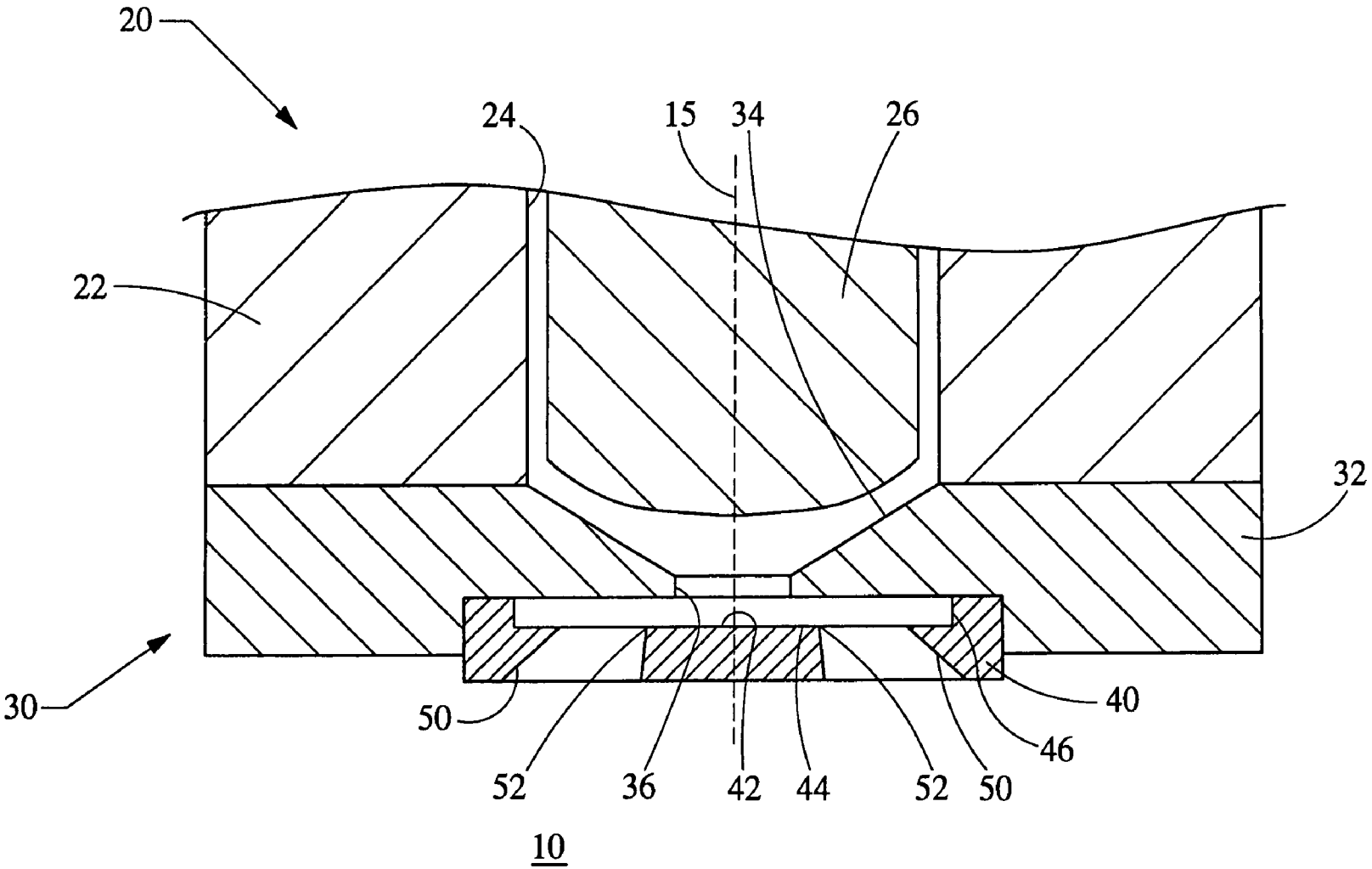
FIG. 1 depicts a cross-sectional view, partially cut away, of a nozzle for a low pressure fuel injector constructed in accordance with the teachings of the present invention.

Turning now to the figures, FIG. 1 depicts a cross-sectional of a nozzle 20 constructed in accordance with the teachings of the present invention. The nozzle 20 is formed at a lower end of a low pressure fuel injector which is used to deliver fuel to a cylinder 10 of an engine, such as an internal combustion engine of an automobile. An injector body 22 defines an internal passageway 24 having a needle 26 positioned therein. The injector body 22 defines a longitudinal axis 15, and the internal passageway 24 extends generally parallel to the longitudinal axis 15. A lower end of the injector body 22 defines a nozzle body 32. It will be recognized by those skilled in the art that the injector body 22 and nozzle body 32 may be integrally formed, or alternatively the nozzle body 32 may be separately formed and attached to the distal end of the injector body 22 by welding or other well known techniques.

In either case, the nozzle body 32 defines a valve seat 34 leading to a valve outlet 36. The needle 26 is translated longitudinally in and out of engagement with the valve seat 34 preferably by an electromagnetic actuator or the like. In this manner, fuel flowing through the internal passageway 24 and around the needle 26 is either permitted or prevented from flowing to the valve outlet 36 by the engagement or disengagement of the needle 26 and valve seat 34.

The nozzle 20 further includes a metering plate 40 which is attached to the nozzle body 32. It will be recognized by those skilled in the art that the metering plate 40 may be integrally formed with the nozzle body 32, or alternatively may be separately formed and attached to the nozzle body 32 by welding or other well known techniques. In either case, the metering plate 40 defines a nozzle cavity 42 receiving fuel from the valve outlet 36. The nozzle cavity 42 Is generally defined by a bottom wall 44 and a side wall 46 which are formed into the metering plate 40. The metering plate 40 further defines a plurality of exit cavities 50 receiving fuel from the nozzle cavity 42. Each exit cavity 50 is radially spaced from the longitudinal axis 15 and the valve outlet 36 and meets the nozzle cavity 42 at an exit orifice 52.

Figure 2:
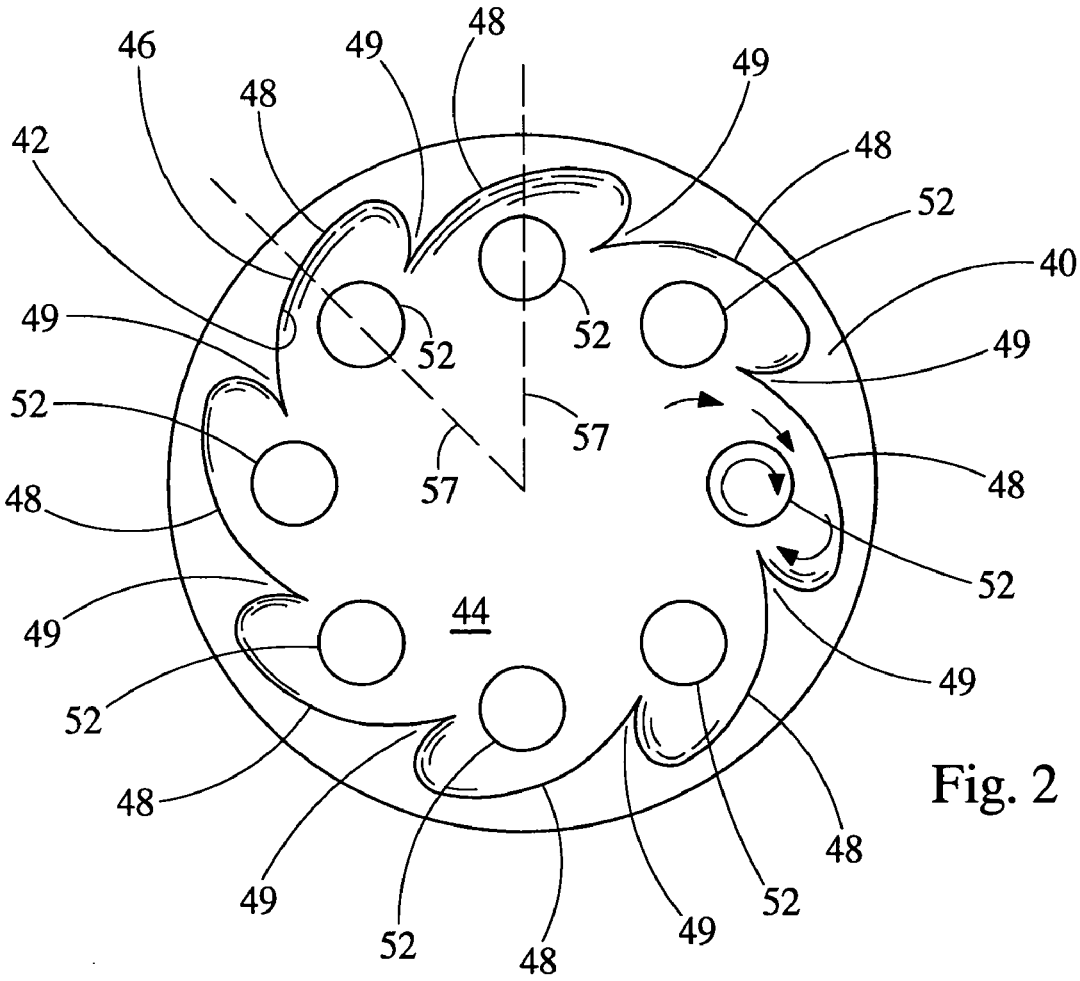
FIG. 2 is a plan view of the metering plate which forms a portion of the nozzle depicted in FIG. 1.

The metering plate 40 has been uniquely designed to enhance the atomization of the fuel injected into the cylinder 10 of the engine, as will now be described with reference to FIGS. 2 and 3. As best seen in FIG. 2, the nozzle cavity 42 has been uniquely designed to introduce a swirl to the fuel flow through the exit orifices 52, as shown by the rotating arrows in the figure. The plurality of exit orifices 52 can clearly be seen, each orifice aligned along a radial axis 57. The nozzle cavity 42 generally takes a flower-shape, wherein a plurality of oblong pedals are disposed proximate each exit orifice which is radially spaced from the longitudinal axis 15 and center point 56 of the metering plate 40. Stated another way, the sidewall 46 of the nozzle cavity 42 is comprised of a series of arcuate segments 48. The curvature of each arcuate segments 48 is asymmetric relative to the radial axis 57 and have a changing slope. Stated another way, the sidewall 46 defines a plurality of triangularly shaped arms 49 which project radially inwardly. The arms 49 are located circumferentially between adjacent exit orifices 52 in their cavities 50, have arcutate sidewalls, and are asymmetric between the two adjacent exit orifices 52. Thus, the sidewall 46 has a radial position which varies circumferentially around the metering plate in a manner to introduce the tangential component to the fuel flowing through the exit orifices 52.

Figure 3:
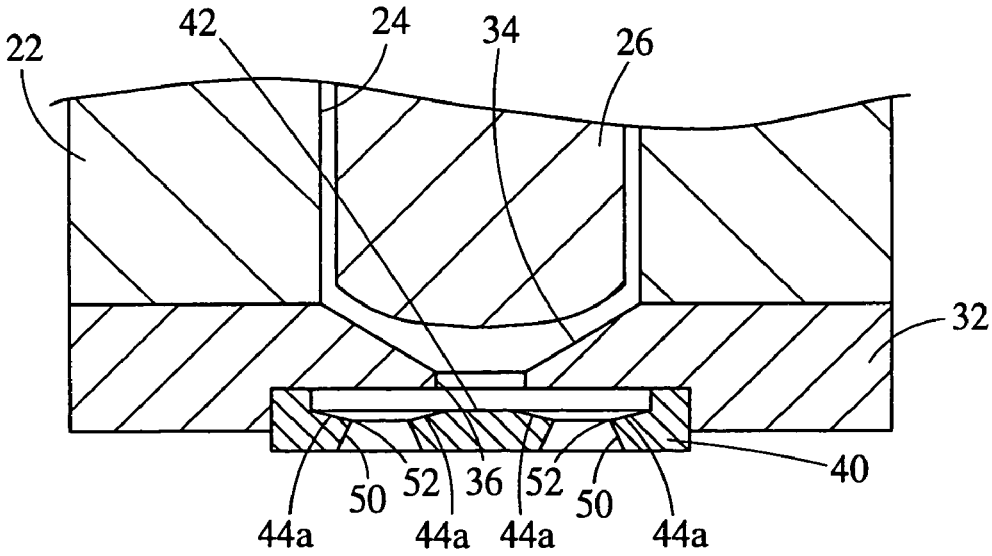
FIG. 3 is a cross-sectional view of another embodiment of a nozzle for a low pressure fuel injector constructed in accordance with the teachings of the present invention.

As best seen in FIG. 3, the bottom wall 44 may include annular portions 44*a* in the area proximate each exit cavity 50 in exit orifice 52 which slope downwardly. By providing a downwardly sloping portion 44*a* proximate each exit cavity 50, the swirling effect to the fuel flow may be further enhanced.

Figure 4:
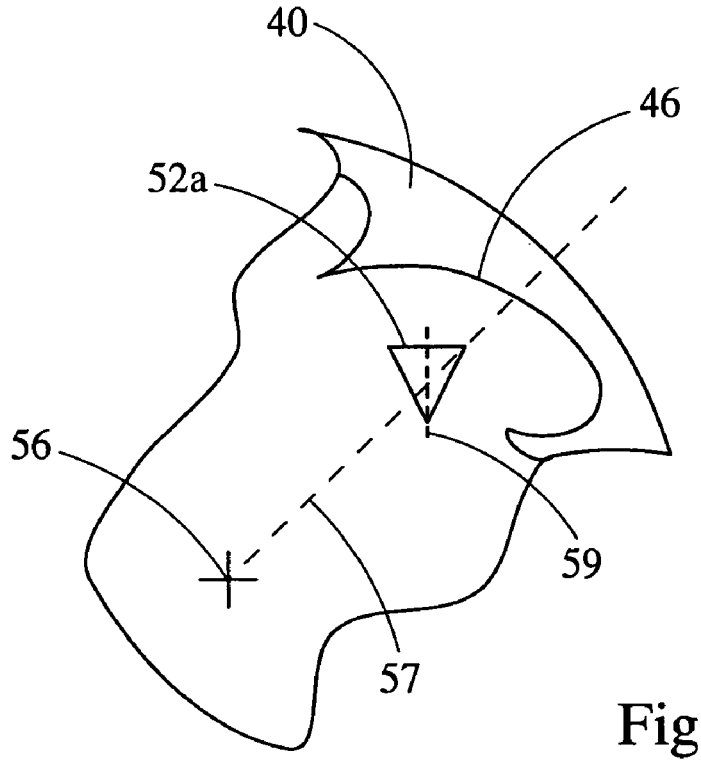
FIG. 4 is plan view, partially cut-away, of another embodiment of the metering plate depicted in FIG. 1.

In accordance with another aspect of the present invention, the exit orifices 52 may be uniquely designed in order to even further enhance the atomization of the fuel flowing into the engine cylinder 10. As shown in FIG. 4, an exit orifice 52*a* has been depicted as being triangular in shape. Notably, the triangular shaped orifice 52*a* has an axis of symmetry 59 which is not aligned with the radial axis 57 of the exit cavity 50. Notably, the exit orifice 52*a* is oriented asymmetrically relative to the radial axis 57.

Figure 5:
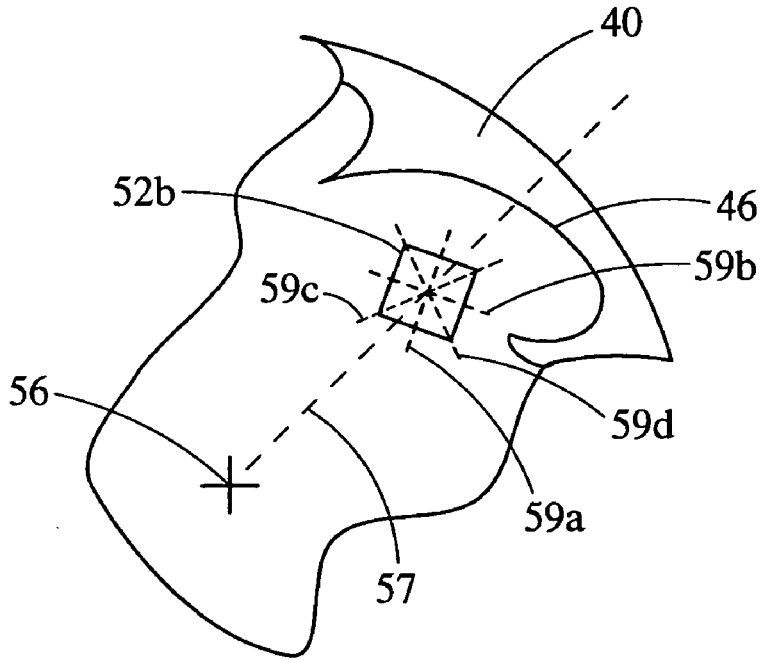
FIG. 5 is a plan view, partially cut-away, of another embodiment of the metering plate depicted in FIG. 2.
Figure 6:
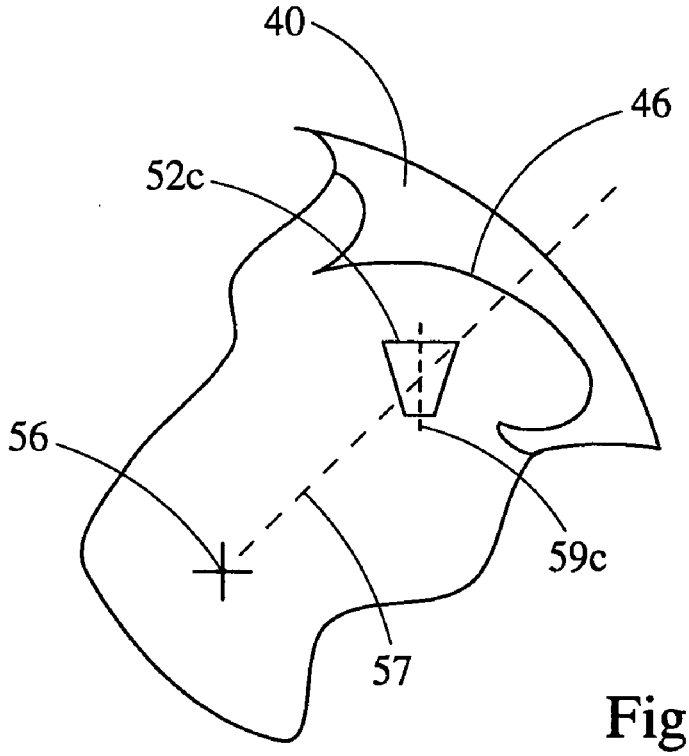
FIG. 6 is a plan view, partially cut-away, of another embodiment of the metering plate depicted in FIG. 2.
Figure 7:
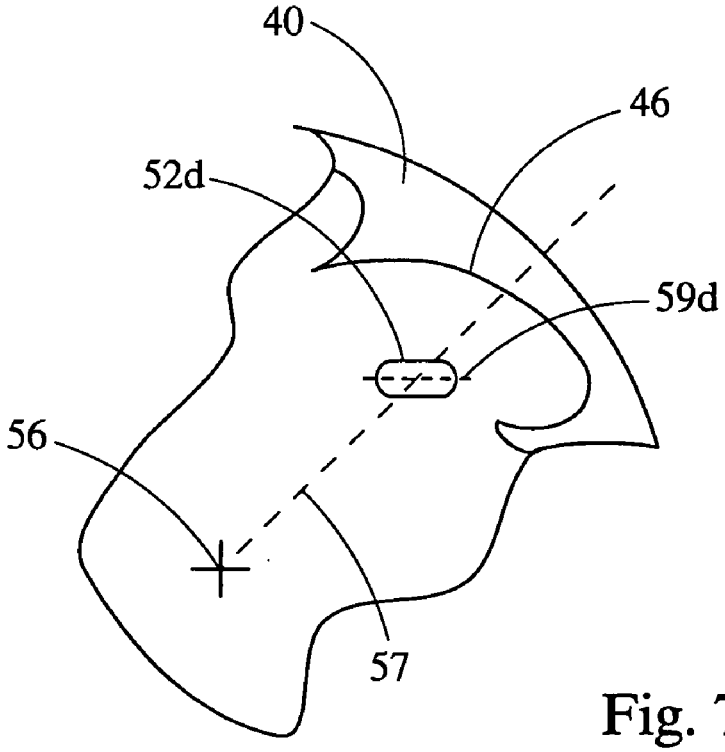
FIG. 7 is a plan view, partially cut-away, of another embodiment of the metering plate depicted in FIG. 2.

It will also be recognized that the exit orifice 52 can take many other shapes. By orienting the exit orifices 52 asymmetrically, a tangential component or swirl is further induced into the fuel flowing through the metering plate 40 and into the engine cylinder 10. As shown in FIG. 5, the exit orifice 52*b* is square in shape, and includes four axes of symmetry 59*a*, 59*b*, 59*c* and 59*d*. In this case, the axes 59*a*–59*d* are not aligned with the radial axis 57 of the exit cavity 50. FIG. 6 depicts the exit orifice 52*e* as taking a trapezoidal shape, wherein the axis of symmetry 59*e* is not aligned with the radial axis 57 of the exit cavity 50. FIG. 7 depicts an exit cavity 52*f* which is ellipsoidal or oblong in shape and defines an axis of symmetry 59*f* which is not aligned with the radial axis 57 of the exit orifice of the exit cavity 50.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate defining a nozzle cavity receiving fuel from the valve outlet;

the metering plate defining a plurality of exit cavities receiving fuel from the nozzle cavity, each exit cavity radially spaced from the valve outlet and oriented along a radial axis, each exit cavity meeting the nozzle cavity at an exit orifice; and each exit orifice having one or more axis of symmetry, and wherein none of the one or more axis of symmetry is aligned with the radial axis.

2. The nozzle of claim 1, wherein at least one exit orifice is triangular.

3. The nozzle of claim 1, wherein at least one exit orifice is trapezoidal.

4. The nozzle of claim 1, wherein at least one exit orifice is square or rectangular.

5. The nozzle of claim 1, wherein at least one exit orifice is ellipsoidal.

6. The nozzle of claim 1, wherein all of the plurality of exit cavities are evenly distributed along a circular pattern having a diameter greater than a diameter of the valve outlet.

7. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate defining a nozzle cavity receiving fuel from the valve outlet, the nozzle cavity defined by a side wall and a bottom wall;

the metering plate defining a plurality of exit cavities receiving fuel from the nozzle cavity, each exit cavity radially spaced from the longitudinal axis and oriented along a radial axis; and the side wall of the nozzle cavity being positioned adjacent the plurality of exit cavities and including a series of arcuate segments to provide a tangential component to the fuel flowing into the plurality of exit cavities.

8. The nozzle of claim 7, wherein the curvature of the arcuate segments is asymmetric relative to the radial axes.

9. The nozzle of claim 7, wherein the curvature of the arcuate segments has a changing slope.

10. The nozzle of claim 7, wherein the side wall and its arcuate segments define a plurality of triangularly shaped arms.

11. The nozzle of claim 10, wherein the arms are located circunferentially between adjacent exit cavities.

12. The nozzle of claim 7, wherein the side wall has a flower-shape.

13. The nozzle of claim 12, wherein the pedals are oblong.

14. The nozzle of claim 7, wherein the side wall has a radial position which varies circumferentially around the metering plate.

15. The nozzle of claim 7, wherein the bottom wall slopes downwardly in the area proximate each exit cavity.

16. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate defining a nozzle cavity receiving fuel from the valve outlet, the nozzle cavity defined by a side wall and a bottom wall;

the metering plate defining a plurality of exit cavities receiving fuel from the nozzle cavity, each exit cavity radially spaced from the longitudinal axis and oriented along a radial axis;

each exit cavity having a frustum shape extending between an upstream end of the exit cavity and a downstream end of the exit cavity, the upstream end having a smaller diameter than the downstream end, the upstream end defining an exit orifice in communication with the nozzle cavity, each exit orifice having one or more axis of symmetry, and wherein none of the one or more axis of symmetry is aligned with the radial axis.

17. The nozzle of claim 16, wherein the side wall is comprised of a series of arcuate segments to provide a tangential component to the fuel flowing into the plurality of exit cavities.

18. The nozzle of claim 17, wherein the curvature of the arcuate segments is asymmetric relative to the radial axes.

* * * * *

UNITED STATES PATENT AND TRADEMARK OFFICE

CERTIFICATE OF CORRECTION

PATENT NO. : 7,168,637 B2
APPLICATION NO. : 10/983118
DATED : January 30, 2007
INVENTOR(S) : Lakhi N. Goenka et al.

It is certified that error appears in the above-identified patent and that said Letters Patent is hereby corrected as shown below:

On the Title Page, Item 56

Page 2, under "U.S. PATENT DOCUMENTS", after "6,394,367" delete "B1" and substitute --B2-- in its place.

Page 2, under "U.S. PATENT DOCUMENTS", after "6,439,482" delete "B1" and substitute --B2-- in its place.

Page 2, under "U.S. PATENT DOCUMENTS", after "6,439,484" delete "B1" and substitute --B2-- in its place.

Page 2, under "U.S. PATENT DOCUMENTS", after "6,499,674" delete "B1" and substitute --B2-- in its place.

Page 2, under "U.S. PATENT DOCUMENTS", after "6,502,769" delete "B1" and substitute --B2-- in its place.

Page 2, under "U.S. PATENT DOCUMENTS", after "6,520,145" delete "B1" and substitute --B2-- in its place.

Page 2, under "U.S. PATENT DOCUMENTS", after "6,578,778" delete "B1" and substitute --B2-- in its place.

Page 2, under "U.S. PATENT DOCUMENTS", after "6,616,072" delete "B1" and substitute --B2-- in its place.

Page 2, under "U.S. PATENT DOCUMENTS", after "6,626,381" delete "B1" and substitute --B2-- in its place.

Page 2, under "U.S. PATENT DOCUMENTS", after "6,644,565" delete "B1" and substitute --B2-- in its place.

Page 2, under "U.S. PATENT DOCUMENTS", after "6,666,388" delete "B1" and substitute --B2-- in its place.

Page 2, under "U.S. PATENT DOCUMENTS", after "6,669,103" delete "B1" and substitute --B2-- in its place.

Page 2, under "U.S. PATENT DOCUMENTS", after "6,669,116" delete "B1" and substitute --B2-- in its place.

UNITED STATES PATENT AND TRADEMARK OFFICE

CERTIFICATE OF CORRECTION

PATENT NO. : 7,168,637 B2
APPLICATION NO. : 10/983118
DATED : January 30, 2007
INVENTOR(S) : Lakhi N. Goenka et al.

It is certified that error appears in the above-identified patent and that said Letters Patent is hereby corrected as shown below:

On the Title Page, Item 56 (cont'd)

Page 2, after "6,705,274" delete "B1" and substitute --B2-- in its place.

Page 2, after "6,708,904" delete "B1" and substitute --B2-- in its place.

Page 2, after "6,708,905" delete "B1" and substitute --B2-- in its place.

Page 2, after "6,708,907" delete "B1" and substitute --B2-- in its place.

Page 2, after "6,712,037" delete "B1" and substitute --B2-- in its place.

Page 2, after "6,719,223" delete "B1" and substitute --B2-- in its place.

Page 2, after "6,739,525" delete "B1" and substitute --B2-- in its place.

Page 2, after "6,758,420" delete "B1" and substitute --B2-- in its place.

Page 2, after "6,764,033" delete "B1" and substitute --B2-- in its place.

Page 2, after "6,766,969" delete "B1" and substitute --B2-- in its place.

Column 5, in claim 11, line 2, before "between adjacent" delete "circunferentially" and substitute --circumferentially-- in its place.

Signed and Sealed this

Twelfth Day of June, 2007

JON W. DUDAS
*Director of the United States Patent and Trademark Office*